US011257652B2

(12) United States Patent
He et al.

(10) Patent No.: US 11,257,652 B2
(45) Date of Patent: Feb. 22, 2022

(54) INSULATOR WITH CONDUCTIVE DISSIPATIVE COATING

(71) Applicant: Richardson Electronics, Ltd., LaFox, IL (US)

(72) Inventors: Min He, Downers Grove, IL (US); Norman Wandke, Naperville, IL (US); Thomas Muchowicz, Elk Grove Village, IL (US)

(73) Assignee: Richardson Electronics, Ltd., La Fox, IL (US)

( * ) Notice: Subject to any disclaimer, the term of this patent is extended or adjusted under 35 U.S.C. 154(b) by 79 days.

(21) Appl. No.: 16/786,303

(22) Filed: Feb. 10, 2020

(65) Prior Publication Data

US 2021/0249216 A1 Aug. 12, 2021

(51) Int. Cl.
*H01J 9/24* (2006.01)
*H01J 35/16* (2006.01)

(52) U.S. Cl.
CPC ..... *H01J 35/16* (2013.01); *H01J 9/24* (2013.01)

(58) Field of Classification Search
CPC .. H01J 35/16; H01J 35/00; H01J 35/02; H01J 35/06; H01J 35/066; H01J 35/165; H01J 9/24
See application file for complete search history.

(56) References Cited

U.S. PATENT DOCUMENTS 6,799,075 B1 * 9/2004 Chornenky ..... A61N 5/1001 378/121
7,965,818 B2 * 6/2011 Jaafar ..... H01J 35/32 378/122

* cited by examiner

*Primary Examiner* — Jurie Yun
(74) *Attorney, Agent, or Firm* — Erise IP, P.A.

(57) ABSTRACT

Embodiments of the invention provide a conductive coating on an insulator of an x-ray tube and a method for applying the conductive coating. The method may use a first process, such as brazing, to join a support to the insulator and a second process, such as vapor deposition, to apply the conductive coating onto a substrate surface of the insulator. The second process may be carried out after the first process without any damage to x-ray tube insulator assembly.

20 Claims, 6 Drawing Sheets

INSULATOR WITH CONDUCTIVE DISSIPATIVE COATING

BACKGROUND

1. Field

Embodiments of the invention relate to x-ray tubes. More specifically, embodiments of the invention relate to x-ray tubes with insulators that include a conductive coating.

2. Related Art

X-ray tubes are used to convert electrical input into x-rays. In an x-ray tube a cathode emits electrons into a vacuum of the x-ray tube. A large voltage between the cathode and anode accelerates the electrons towards the anode, where they strike the x-ray target surface. As the electrons strike the target, a portion of them are backscattered, and a portion have a number of inelastic collisions with both the electrons and the nuclei of the target atoms. The process of the electrons decelerating and changing directions in the target material produces x-rays. The x-rays are emitted in a hemispherical pattern from the surface of the target. Some of the x-rays then travel through the vacuum inside the x-ray tube and pass through an x-ray transparent window, typically made from beryllium. From here, they travel through the tube housing window and a collimator and can then be used for diagnostic purposes in a CT scanner. About 40% of the electrons are backscattered from the target and these can bombard the cathode and cathode insulator. As they bombard the cathode insulator, the electrons will charge up the surface of the insulator, leading to changes in the insulator's electric field arcing and failure of the insulator.

To reduce the charge build-up on the insulator, a conductive dissipative (CD) coating may be used. Such a conductive dissipative coating can be composed of metal oxides, such as titanium oxide and/or chromium oxide. The conductive coating is typically sprayed or brushed onto an individual insulator following a sintering process, which requires high temperatures above 1500° C. The insulator is typically attached to other components of the x-ray tube by metallization and brazing, which are lower temperature operations than the sintering process. A sintered conductive coating must be applied before lower temperature processes, such as brazing, because the high temperatures of the sintering process would melt a filler metal of the brazing process. Typical spraying or brushing processes can only be applied to one part at a time so applying the coating by batch processing is not possible. Further, spraying or brushing of the conductive coating may also be difficult to control and accurately apply.

Accordingly, there is a need for an improved coating processes that can apply a conductive coating after the insulator of the x-ray tube has been joined to supports without weakening or damaging the bond between the insulator and the support. Such a coating processes is preferably easy to control and can accurately apply conductive coatings to any desired portion of the insulator or onto multiple insulators simultaneously.

SUMMARY

Embodiments of the invention solve the above-mentioned problems by providing a method and system for providing a conductive coating that can be applied to an insulator of an x-ray tube after joining components to the insulator. In some embodiments, the method may apply a plurality of conductive coatings to a plurality of insulators simultaneously.

A first embodiment of the invention is directed to a method for manufacturing an x-ray tube, said x-ray tube comprising a frame, an anode, a cathode, and at least one insulator surrounding the cathode, the method comprising the steps of securing the at least one insulator to at least one support by brazing using a filler material, then applying a first layer of a conductive dissipative coating to a surface of the insulator using a vapor deposition process, wherein the vapor deposition process uses a temperature that is lower than the melting point temperature of the filler material, wherein the conductive dissipative coating is configured to reduce an electrical charge buildup on the at least one insulator.

A second embodiment of the invention is directed to a system for reducing electrical charge buildup of an x-ray tube, the system comprising a frame, an anode, a cathode, an insulator joining the cathode to the frame, the insulator comprising at least one surface having a conductive dissipative coating thereon, whereby said conductive dissipative coating is applied by a vapor deposition process, wherein the conductive dissipative coating is configured to reduce an electrical charge buildup on the insulator.

A third embodiment of the invention is directed to a method for manufacturing a plurality of insulators of a respective plurality of x-ray tubes, the method comprising the steps of securing the plurality of insulators to a respective plurality of supports by brazing using a filler material, then applying a conductive dissipative coating to a surface of each of the plurality of insulators simultaneously using a vapor deposition process, wherein the vapor deposition process uses a temperature that is lower than the melting point temperature of the filler material, wherein the conductive dissipative coating is configured to reduce an electrical charge buildup of each of the insulators.

Additional embodiments of the invention are directed to a method for performing a sputtering process on an insulator of an x-ray tube.

This summary is provided to introduce a selection of concepts in a simplified form that are further described below in the detailed description. This summary is not intended to identify key features or essential features of the claimed subject matter, nor is it intended to be used to limit the scope of the claimed subject matter. Other aspects and advantages of the invention will be apparent from the following detailed description of the embodiments and the accompanying drawing figures.

BRIEF DESCRIPTION OF THE DRAWING FIGURES

Embodiments of the invention are described in detail below with reference to the attached drawing figures, wherein.

Figure 1:
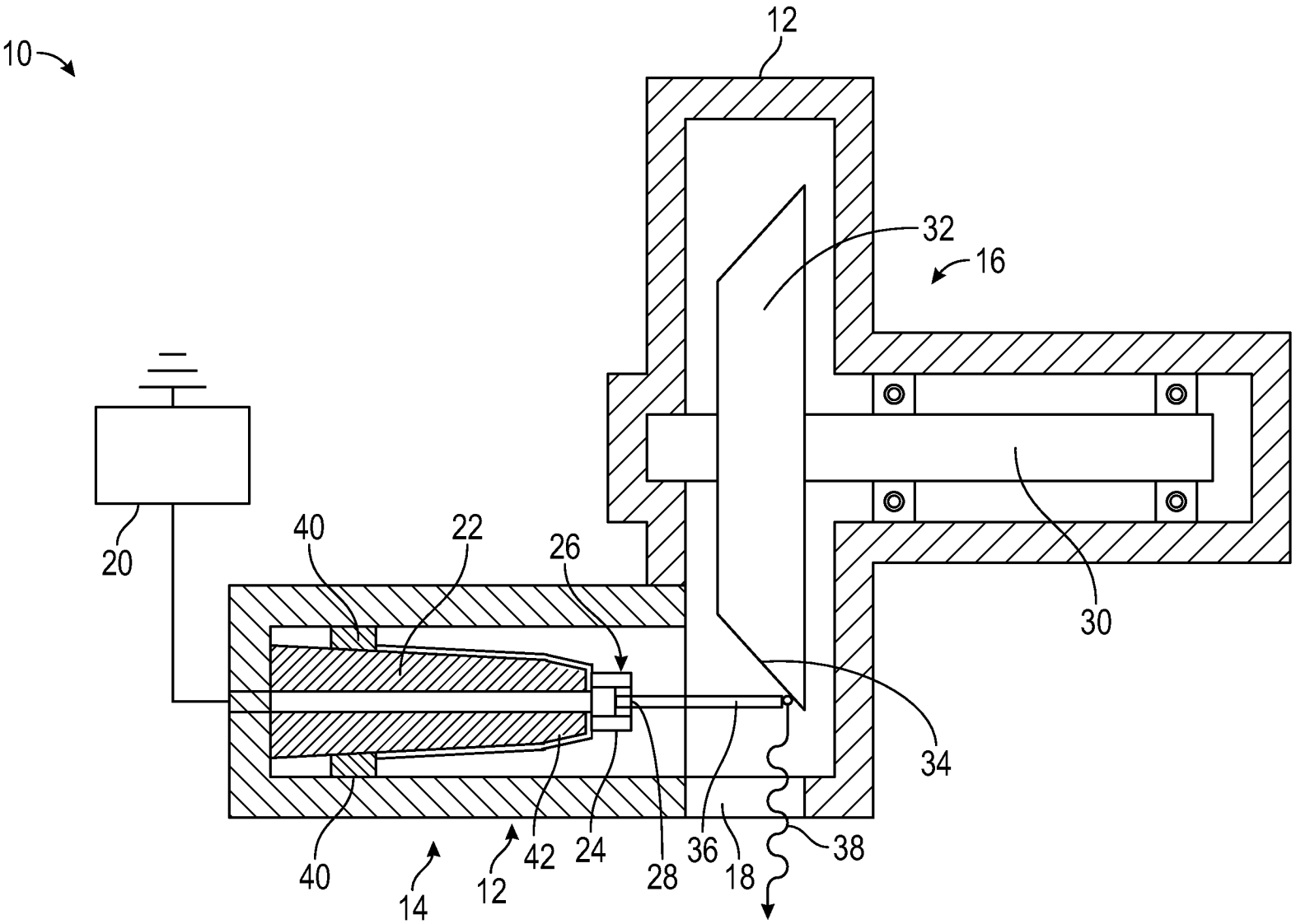
FIG. 1 is an exemplary x-ray tube.

The drawing figures do not limit the invention to the specific embodiments disclosed and described herein. The drawings are not necessarily to scale, emphasis instead being placed upon clearly illustrating the principles of the invention.

DETAILED DESCRIPTION

The following detailed description references the accompanying drawings that illustrate specific embodiments in which the invention can be practiced. The embodiments are intended to describe aspects of the invention in sufficient detail to enable those skilled in the art to practice the invention. Other embodiments can be utilized and changes can be made without departing from the scope of the invention. The following detailed description is, therefore, not to be taken in a limiting sense. The scope of the invention is defined only by the appended claims, along with the full scope of equivalents to which such claims are entitled.

In this description, references to "one embodiment," "an embodiment," or "embodiments" mean that the feature or features being referred to are included in at least one embodiment of the technology. Separate references to "one embodiment," "an embodiment," or "embodiments" in this description do not necessarily refer to the same embodiment and are also not mutually exclusive unless so stated and/or except as will be readily apparent to those skilled in the art from the description. For example, a feature, structure, act, etc. described in one embodiment may also be included in other embodiments, but is not necessarily included. Thus, the technology can include a variety of combinations and/or integrations of the embodiments described herein.

Embodiments of the invention use various coating processes to apply the conductive coating after the insulator of the x-ray tube has been joined to supports. It is desirable that the coating process not weaken or damage the bond joining the insulator to the other components of the x-ray tube, such as the support. Further, embodiments are contemplated that use coating processes that are easy to control and can accurately apply conductive coatings to desired portions of the insulator. In some embodiments, multiple conductive coatings may be applied onto multiple insulators simultaneously.

FIG. 1 depicts an embodiment of an x-ray tube 10. The x-ray tube 10 may comprise a frame 12, a cathode assembly 14, an anode assembly 16, a window 18, a power source 20, and an insulator 22. In some embodiments, the frame 12 may be a glass envelope or a metal structure. The frame 12 may comprise the window 18 to allow x-rays to pass through the x-ray tube 10. The cathode assembly 14 may comprise a cathode cup 24 and a cathode 26 with a filament 28. The anode assembly 16 may comprise a shaft 30 and an anode 32 with a target surface 34. In some embodiments, the anode 32 may be a rotating anode 32, as shown. In such embodiments, the anode 32 may rotate about the shaft 30 of the anode assembly 16.

In some embodiments, the insulator 22 may be used to join the cathode assembly 14 to the frame 12. In such embodiments, the cathode assembly 14 may be supported by the insulator 22. The insulator 22 may be secured to the frame 12. The insulator 22 is coated with a conductive coating 42 on at least a portion of the outer surface of the insulator 22, as shown. In one embodiment, the conductive coating 42 is located on the surface of the insulator 22 between the cathode cup 24 and a support 40. In some embodiments, the frame 12 may comprise at least one support 40 that is desirably held at ground electrical potential. The power source 20 may be electrically connected to the cathode assembly 14 to supply an electrical potential to the cathode 26. The support 40 may be comprised of a metal material that is operable to conduct an electrical current.

During operation of the x-ray tube 10, the power source 20 may supply an electrical potential to the cathode 26. The electrical potential of the cathode 26 may produce an electron beam 36 from the cathode 26 to the target surface 34 of the anode 32. When electrons from the electron beam 36 strike the target surface 34 of the anode 32, x-rays 38 may be produced. The x-rays 38 may pass through the window 18 and be utilized as diagnostic x-rays 38. During the x-ray production process, secondary electrons and backscattered electrons may also be produced. These electrons may be absorbed into the insulator 22 creating an electrical charge buildup on the insulator 22.

Figure 2A:
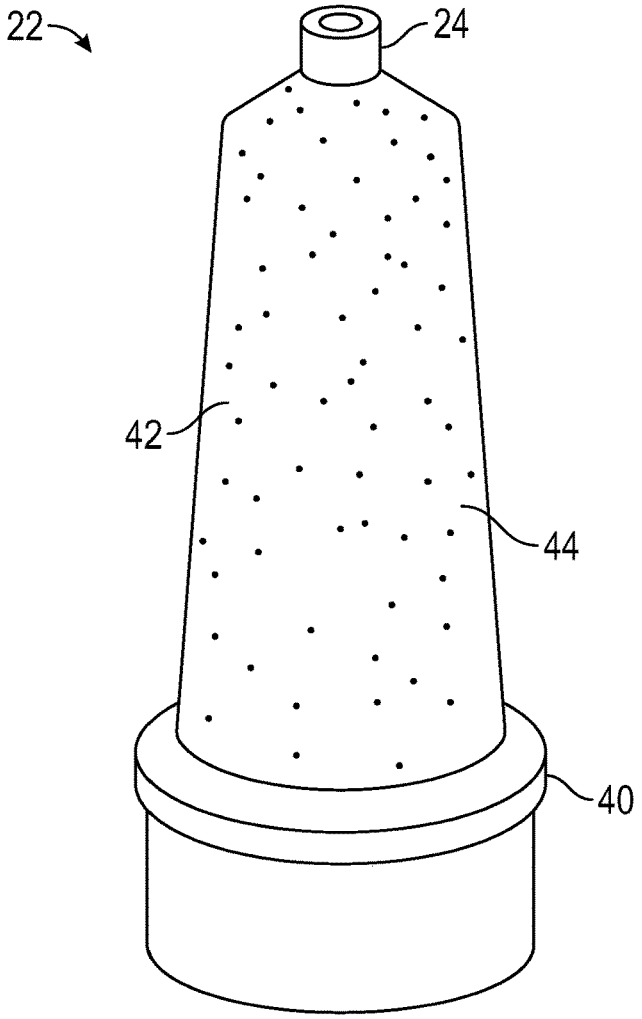
FIG. 2A is an embodiment of an insulator for an x-ray tube.

FIG. 2A depicts an embodiment of the insulator 22. In some embodiments, the insulator 22 may be made from a ceramic material, such as, for example, glass or alumina. The insulator 22 may comprise a conductive coating 42 to decrease the electrical resistivity of the insulator 22 on a substrate surface 44 of the insulator 22. The conductive coating 42 may be composed of any of a variety of materials, such as, for example, aluminum nitride, boron nitride, chromium nitride, silicon nitride, and titanium nitride. In some embodiments, a combination of materials may be used. For example, it may be desirable to use a combination of aluminum nitride and titanium nitride. Further, various ratios of each of the materials may be used. For example, the conductive coating 42 may be composed of about 95% aluminum nitride doped with less than about 5% titanium nitride. In another example, the conductive coating 42 may be composed of about 95% aluminum nitride doped with less than about 5% of another nitride. The specific material composition of the conductive coating 42 may be selected based on considerations of electrical conductivity, cost, and compatibility with the manufacturing processes described herein. It should be understood that other suitable materials not described herein may be used for the conductive coating 42. In some embodiments, the conductive coating 42 may be a conductive dissipative coating. The conductive coating 42 may allow the electrical charge buildup to be dissipated from the insulator 22. In some embodiments, the conductive coating 42 may be applied on a substrate surface 44 of the insulator 22 using a vapor deposition process, as will be discussed below. In some embodiments, the substrate surface 44 may be the outer surface of the insulator 22, as shown. The conductive coating may be applied on all or on isolated portions of the substrate surface 44.

A support 40 may be secured around the insulator 22, as shown. In some embodiments, the support 40 may be used to hold the insulator 22 and/or to mount the insulator 22 to the frame 12 of the x-ray tube 10. In some embodiments, the support 40 may be attached to the insulator 22 at various other locations on the insulator 22. For example, the support 40 may be attached on an end of the insulator 22. In some embodiments, a plurality of supports 40 may be secured to the insulator 22. In some embodiments, the insulator 22 may be used to support the cathode assembly 14 and electrically isolate the cathode assembly 14 from other components of the x-ray tube 10, such as the frame 12 and the support 40.

The support 40 is preferably composed of a metal material, however, can be composed of other materials having similar properties. In some embodiments, the support 40 is a metal end of the insulator 22.

The terms conductive, conductive dissipative, or insulative as described herein may refer to a relative conductivity of various components. For example, the insulator 22 may be described as insulative because it has a lower conductivity than the conductive coating 42. As such, the conductive coating 42 may be described as conductive because it has a relatively high conductivity when compared with the insulator 22 but may not be considered a conductive electrostatic discharge material by the certain other standards.

In some embodiments, the conductive coating 42 may provide an electrical discharge path for electrons on the outer surface of the insulator 22 to dissipate the electrical charge. The conductive coating 42 may decrease the electrical resistivity of the insulator 22, while still allowing the insulator 22 to electrically isolate the cathode 26 from a ground potential of the frame 12. A material used for the conductive coating 42 of the insulator 22 may be selected based on the electrical conductivity of the material. In some embodiments, the material may be selected based on an electrical discharge rate. The electrical discharge rate may be the rate of reduction in the electrical charge of the insulator 22 and may vary depending on the material used for the conductive coating 42. For example, in some embodiments, a material having a relatively high electrical conductivity may be selected for the conductive coating 42 to produce a high electrical discharge rate, while in some other embodiments, a material with a lower electrical conductivity may be selected for the conductive coating 42 to produce a lower electrical discharge rate.

Figure 2B:
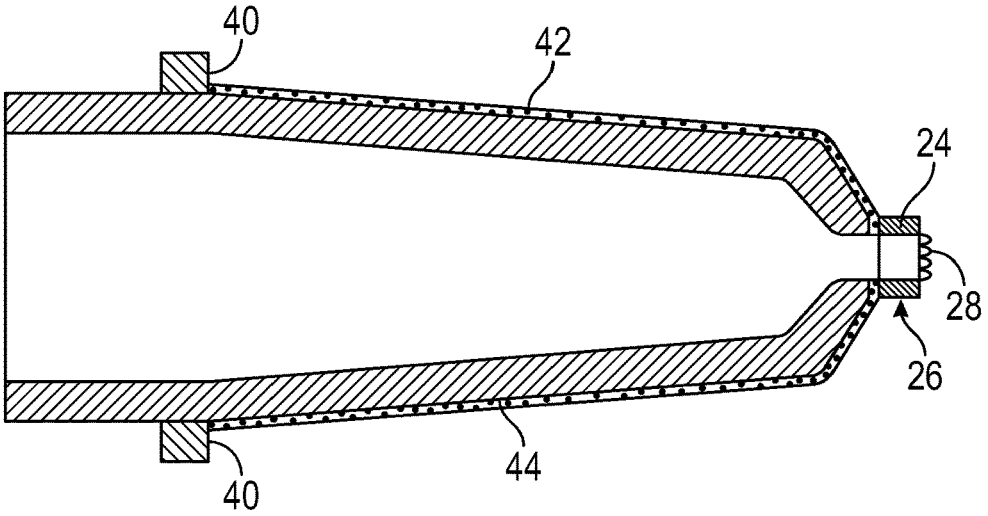
FIG. 2B is a cross-sectional view of an embodiment of an insulator for an x-ray tube.

FIG. 2B shows a cross-sectional view of the insulator 22. The conductive coating 42 can be seen on the outer surface of the insulator 22. The conductive coating 42 may be a thin film covering the outer surface of the insulator 22. In some embodiments, the conductive coating 42 may comprise a plurality of layers. The thickness of the conductive coating 42 may be within a range of 10 nm to 10 μm, though embodiments are contemplated having a different thickness of the conductive coating 42. In some embodiments, the thickness of the conductive coating 42 may be determined based on the coating process used to apply the conductive coating 42. Such a thin coating layer would not be possible using the process of the prior art. In some embodiments, 2-10 layers may be used while it may be desirable to use a single layer in some other embodiments. It should be understood that the conductive coating 42 may comprise any number of layers and each layer may be composed of any number of different chemical compounds. In some embodiments, it may be desirable to include a single layer composed of multiple different chemical compounds. In some embodiments, the conductive coating 42 may include varying numbers of layers at different locations along the outer surface of the insulator 22. For example, a location along the outer surface of the insulator 22 known to hold a higher charge during operation of the x-ray tube 10 may have a larger number of layers or a greater thickness than a location with a smaller charge. The number of layers of the conductive coating 42 may affect the electrical conductivity of the insulator 22, with a higher number of layers corresponding to a higher electrical conductivity. Accordingly, the layering of the conductive coating 42 may be selected based on the expected electrical charge of the insulator 22. In one embodiment, each layer may be made of different materials.

Figure 3:
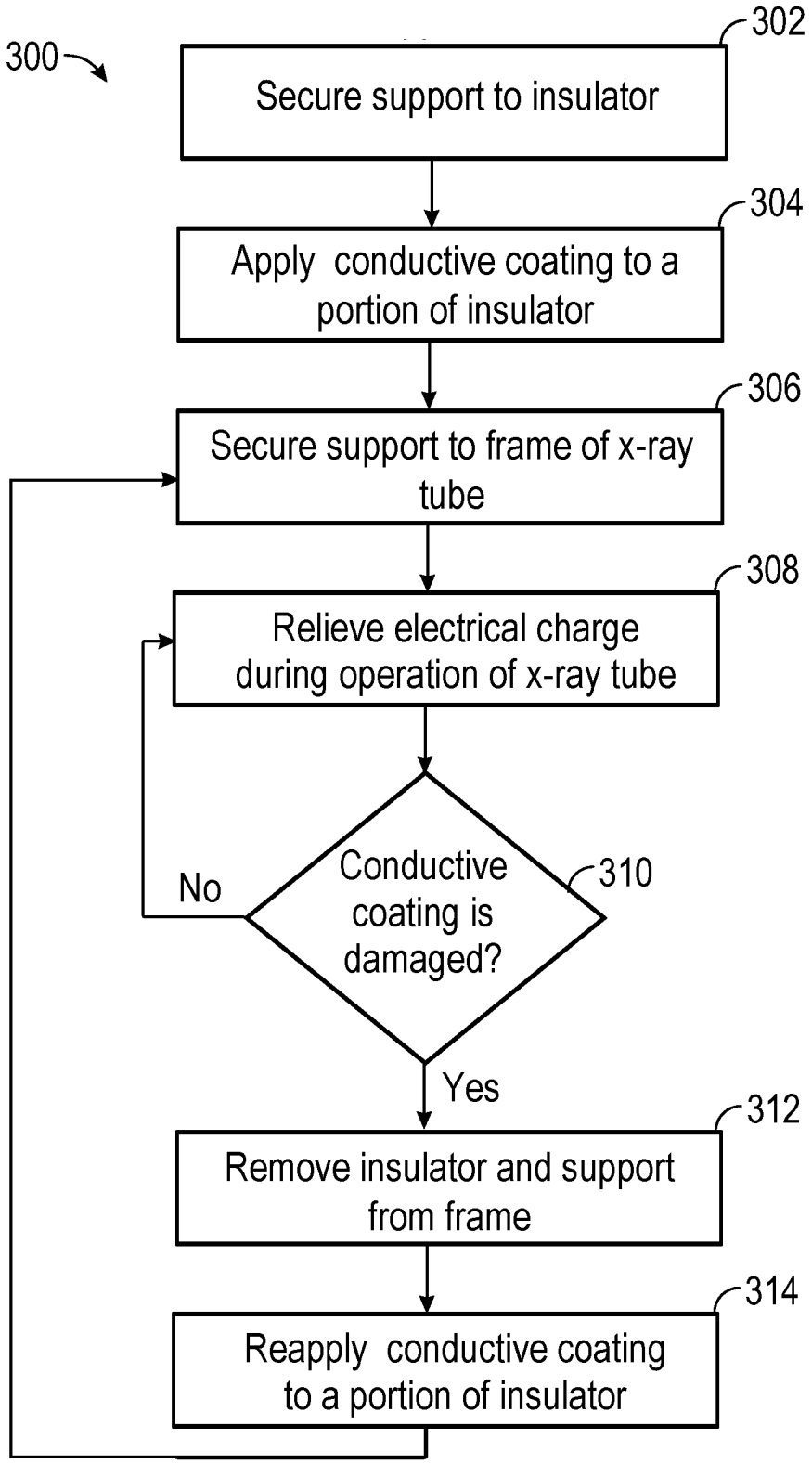
FIG. 3 shows an exemplary method for providing an insulator for an x-ray tube.

FIG. 3 shows steps of a method 300 for providing an insulator 22 of an x-ray tube 10 for some embodiments. At step 302, support 40 may be secured to the insulator 22. In some embodiments, the support 40 may be secured to the insulator 22 using a brazing process 46, as will be described below in reference to FIG. 4. At step 304, the conductive coating 42 may be applied to the insulator 22. In some embodiments, the conductive coating 42 may be applied to the insulator 22 using a vapor deposition process. The conductive coating 42 may be applied after the securing of the support 40 to the insulator 22. In some embodiments, a first temperature may be produced to secure the support 40 to the insulator 22 and a second temperature may be produced from the vapor deposition process to apply the conductive coating 42. The second temperature may be lower than the first temperature. In some embodiments, the conductive coating 42 may be supplied on a surface of at least a portion of the insulator 22. At step 306, the insulator 22 may be secured to the frame 12 of the x-ray tube 10. In some embodiments, the support 40 may also be attached to the frame 12 to thereby support the insulator 22. In some embodiments, the support 40 may be welded to the frame 12.

At step 308, the electrical charge of the insulator 22 may be relieved using the conductive coating 42 to provide an electrical discharge path for electrons on the outer surface of the insulator 22 during operation of the x-ray tube 10. At step 310, the conductive coating 42 may be inspected to determine if the conductive coating 42 has become damaged. If the conductive coating 42 is damaged, the insulator may be removed from the frame 12 at step 312 to be repaired. If the conductive coating 42 is not damaged, the conductive coating 42 may continue to be used to relieve electrical charge during operation of x-ray tube 10. At step 314, the conductive coating 42 may be reapplied or an additional layer may be added. It may be desirable to reapply the conductive coating 42 especially when the conductive coating 42 or the insulator 22 has become damaged. It may also be desirable to reapply the conductive coating 42 to increase the electrical conductivity of the insulator 22 to relieve the electrical charge. After reapplying the conductive coating 42, step 306 may be repeated to re-secure the support 40 to the frame 12 to reassemble the x-ray tube 10 with the repaired coating on the insulator 22.

It should be understood that by applying the conductive coating 42 after the insulator 22 has been joined to the support 40, the manufacturing of the insulator 22 is more versatile. As such, the conductive coating 42 may be applied and reapplied onto the insulator 22 at any time, or additional layers of coating may be added. In some embodiments, the insulator 22 may be recycled and used in a new x-ray tube 10, especially when other components of the x-ray tube 10 become damaged. For example, if the support 40 becomes damaged, the insulator 22 may be secured to a new support 40 and the conductive coating 42 may be reapplied to the insulator 22. Additionally, the x-ray tube 10 may be taken apart so that the insulator 22 is removed from the frame 12 to perform maintenance operations on the x-ray tube 10. The insulator 22 may then be re-secured onto the frame 12, which may be via support 40 or other attachment means, and the conductive coating 42 may be re-applied to the insulator 22. In some embodiments, the insulator 22 may be removed from the x-ray tube 10 and secured to the support 40 of a new x-ray tube 10.

Figure 4:
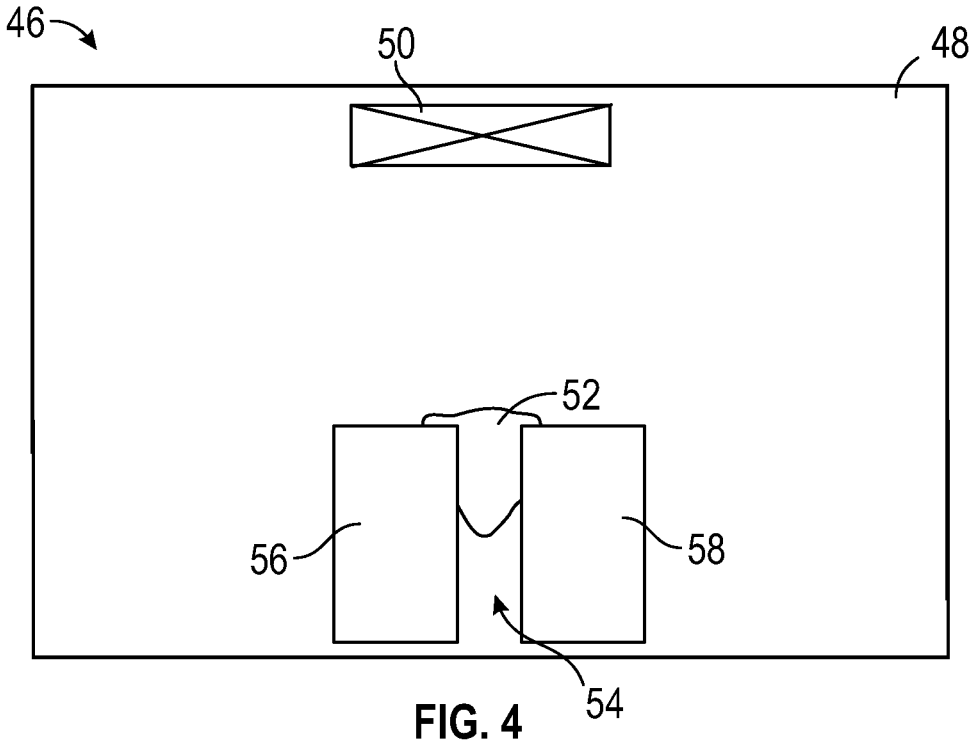
FIG. 4 is a depiction of an exemplary brazing process for an embodiment.

FIG. 4 depicts brazing process 46 for some embodiments. In some embodiments, the brazing process 46 may be carried out with a vacuum or gas environment, such as hydrogen or other suitable gas 48 and use a heat source 50 to provide heat to melt a filler material 52. The vacuum or gas environment 48 may be a furnace. In some embodiments, the filler material 52 may be any of a variety of metal-based materials, such as, for example, copper, silver, gold, platinum, palladium, nickel, indium, tin, or combinations thereof. In some embodiments, the filler material 52 may be selected based on a melting temperature of the filler material 52. For example, the filler material 52 may be selected so that the melting temperature of the filler material is lower than that of a melting temperature of the first part 56 and a melting temperature of the second part 58. The filler material may flow into a gap 54 between a first part 56 and a second part 58. In some embodiments, the first part 56 may be the insulator 22 and the second part 58 may be the support 40. In some embodiments, the brazing process 46 may also be used to join the frame 12 to the insulator 22 to the frame 12. Here the second part 58 may be the frame 12. It should be understood that the brazing process 46 may be a furnace brazing process. Further, the brazing process 46 may be used to secure multiple different parts simultaneously. For example, multiple insulators 22 and supports 40 may be placed in the vacuum environment 48 of the furnace and brazed simultaneously.

Figure 5:
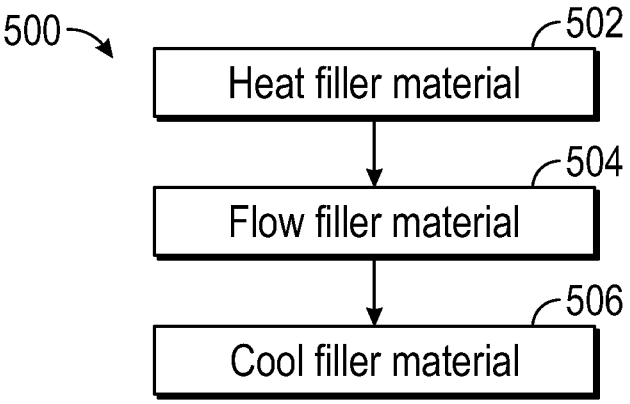
FIG. 5 is a method for performing a brazing process.

FIG. 5 depicts a method 500 for performing a brazing process 46 for some embodiments. The steps of method 500 may be performed using the brazing process 46, as shown in FIG. 4. At step 502, the heat source 50 may provide the heat to the filler material 52 to heat the filler material 52 to a first temperature that is above the melting temperature of the filler material 52. Thus, the filler material 52 may be melted into a liquid state. Next, at step 504, the filler material 52 may be flowed into the gap 54 between the first part 56 and the second part 58. At step 506, the filler material 52 may be cooled to a temperature below the melting temperature of the filler material 52 to solidify the filler material 52. In some embodiments, cooling of the filler material 52 may be accomplished by allowing the filler material 52 and the parts 56, 58 to passively cool, while in some other embodiments, active cooling methods may be used. Active cooling methods for some embodiments may involve providing a coolant to a surface of the parts 56, 58 and filler material 52 to remove heat from the parts 56, 58 and filler material 52. It may be desirable to actively cool the parts 56, 58 and filler material 52 to increase the cooling rate, which may affect material properties of the parts 56, 58 and filler material 52.

In some embodiments, other operations may be used to manufacture the insulator 22, such as a metallization process. The metallization process may be used to apply a metallic coating onto the insulator 22 or any other component of the x-ray tube 10. In some embodiments, the metallic coating may serve a functional purpose such as, increasing compatibility with a joining process, such as brazing process 46 of FIG. 4 or increasing the conductivity. It should be understood that the metallization process may be a low temperature operation that may be carried before the conductive coating is applied onto the insulator 22. Accordingly, it may be desirable that the material of the metallic coating not be heated above a temperature threshold. For example, if the metallic coating is melted above a threshold temperature, the metallic coating may become damaged or ineffective. In some embodiments, it may be desirable that the process for applying the conductive coating 42 not damage the filler material 52 and/or the metallic coating.

Figure 6:
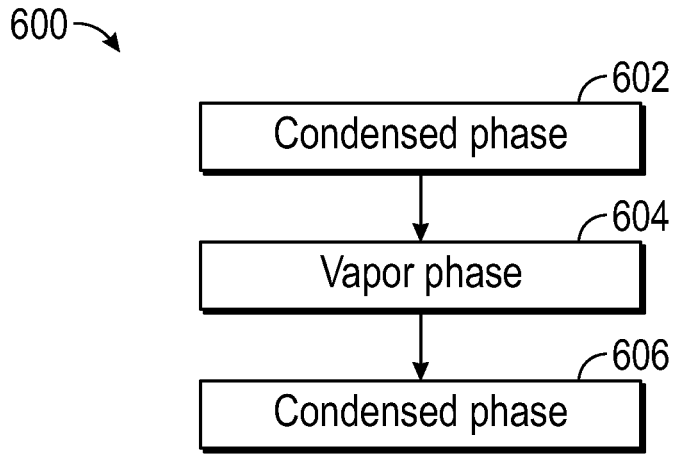
FIG. 6 is a diagram of a physical vapor deposition process for some embodiments.

FIG. 6 shows an exemplary diagram of a physical vapor deposition process 600 for some embodiments. At step 602 the material for the conductive coating 42 is in a condensed phase. In some embodiments, this may be an initial solid state of the material. At step 604 the material for the conductive coating 42 is in a vapor phase. The material may be converted into the vapor phase by an energy input into the material. For example, the material may be heated. In some embodiments, the material may be converted into the vapor phase by evaporation of the material. In some embodiments, the material may be transported and deposited onto the outer surface of the insulator 22 while in the vapor phase. At step 606 the material returns to a condensed phase on the surface of the insulator 22 as a thin film. In some embodiments, the material may solidify on the insulator 22 to cover the outer surface of the insulator 22.

Figure 7:
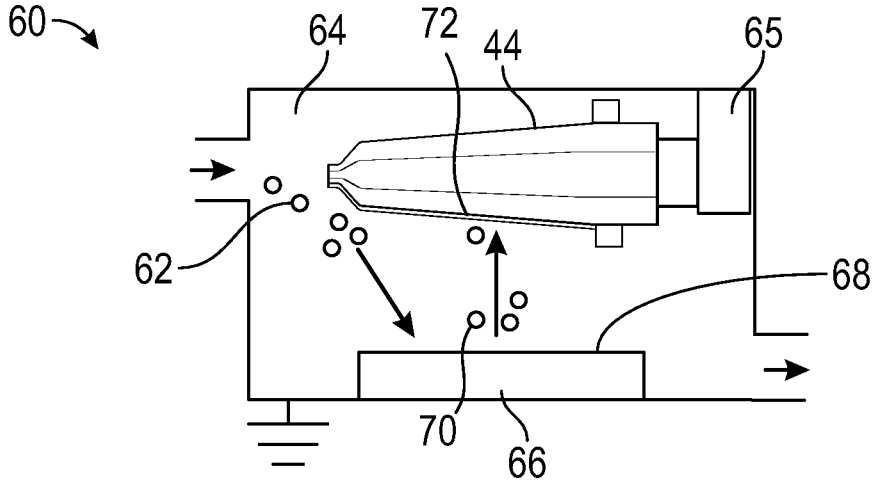
FIG. 7 is a depiction of an exemplary sputtering process.

In some embodiments, the physical vapor deposition process 600 may be any one of a cathodic arc deposition process, an electron beam deposition process, an evaporative deposition process, a close-space sublimation process, a pulsed laser deposition process, a sputtering process 60 (as shown in FIG. 7), a pulsed electron deposition process, and a sublimation sandwich method. It should be understood that the specific type of vapor deposition process may be selected based on the material properties of the insulator 22, the material properties of the conductive coating 42, and a temperature associated with the vapor deposition process.

In some embodiments, the type of vapor deposition process may be selected based on the brazing process 46. For example, a sputtering process 60 may be used because the sputtering process 60 may require a lower temperature than the melting temperature of the filler material 52 of the brazing process 46. Thus, the conductive coating 42 may be applied after the joining of the insulator 22 to other components of the x-ray tube 10. Accordingly, conductive coatings 42 may be reapplied to the insulator 22 that may already be brazed to the frame 12 of the x-ray tube 10.

FIG. 7 depicts an exemplary sputtering process 60. In some embodiments, the sputtering process 60 may be used as the vapor deposition process to apply the conductive coating 42 onto the insulator 22. The sputtering process 60 may supply a sputtering gas 62 into a vacuum environment 64. In some embodiments, the sputtering gas 62 may be argon, though other suitable materials may be used. The sputtering gas 62 may collide with a sputtering target surface 68 of a sputtering target 66. The collision of the sputtering gas 62 with the sputtering target surface 68 of the sputtering target 66 may release sputtered target particles 70 from the sputtering target 66. The sputtered target particles 70 may then travel towards the substrate surface 44 and be deposited on the substrate surface 44 as a thin film 72. In some embodiments, multiple targets made from different coating materials may be used to deposit various compounds in the coating. In some embodiments, the substrate surface 44 may be the outer surface of the insulator 22 and the thin film 72 may be the conductive coating 42. In some embodiments, the insulator 22 may be supported by a rotatable mount 65 within the vacuum environment 64. The rotatable mount 65 may be used to rotate the insulator 22 during the sputtering process 60 to expose the entire substrate surface 44 to the sputtered target particles 70.

It should be understood that the sputtered target particles 70 may be of the same material composition as the sputtering target 66. Accordingly, the material composition of the sputtering target 66 may be selected based on the desired material composition of the conductive coating 42. For example, an aluminum nitride material may be used for the sputtering target 66 to produce a thin film 72 of aluminum nitride on the outer surface of the insulator 22. In some embodiments, other types of metal nitrides or other suitable materials may be used for the sputtering target 66. Additionally, the type of sputtering gas 62 may be selected based on the material composition of the sputtering target 66 so that the sputtering gas 62 is operable to collide with the sputtering target surface 68 and release the sputtered target particles 70. It should be understood that any impurities in the material of the sputtering target 66 may also be present in the sputtered target particles 70. Accordingly, it may be desirable to use a sputtering target 66 with a high purity so that the sputtered target particles 70 have a high purity. The purity as described herein may refer to the percentage of the desired material or lack of impurities in the material.

In some embodiments, the substrate surface 44 may be a plurality of substrate surfaces 44 of a respective plurality of insulators 22. As such, the sputtering process 60 may be used to apply a plurality of conductive coatings 42 onto the plurality of insulators 22 simultaneously. By applying a plurality of conductive coatings 42 to the plurality of insulators 22 simultaneously, the coating process may be completed faster for the plurality of insulators 22 compared to coating processes that only apply the conductive coating 42 to one insulator 22 at a time.

Figure 8:
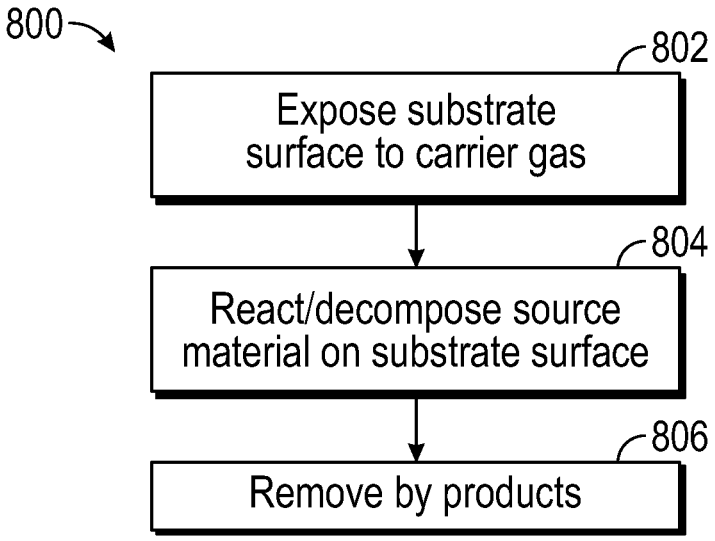
FIG. 8 is a diagram of a chemical vapor deposition process for some embodiments.
Figure 9:
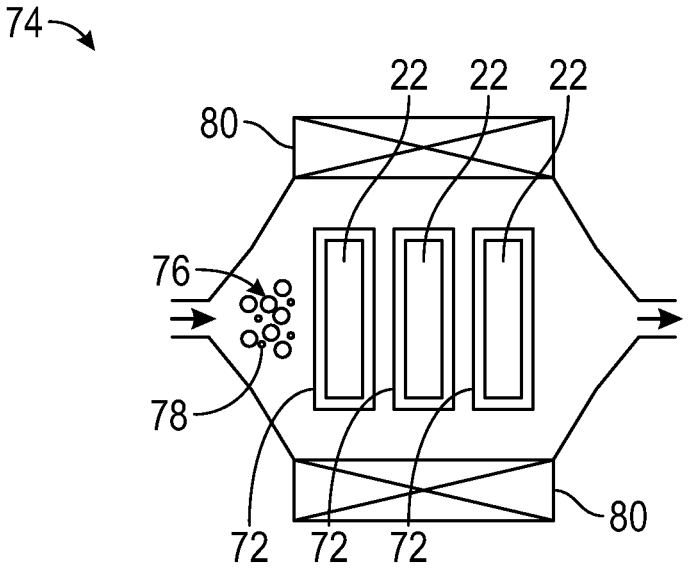
FIG. 9 is a depiction of an exemplary hot-wall thermal chemical vapor deposition process.

FIG. 8 shows a diagram of a chemical vapor deposition process 800 that may be used to apply the conductive coating 42 to the insulator 22 in some embodiments. At step 802 the substrate surface 44 may be exposed to a carrier gas 76, as shown in FIG. 9, comprising a source material 78. The carrier gas 76 may carry the source material 78, which may be the material of the conductive coating 42. At step 804 the source material 78 is either reacted or decomposed on the substrate surface 44 of the insulator 22. In some embodiments, the material composition of the source material 78 may be selected based on a desired reaction of the source material 78 with the substrate surface 44. For example, the source material 78 may initiate a chemical reaction with the material of the substrate surface 44. At step 806 byproducts are removed. The byproducts may be volatile byproducts from the carrier gas 76 or may be byproducts from the reaction of the source material 78 with the substrate surface 44. The chemical vapor deposition process 800 may be any of a variety of chemical vapor deposition processes, such as, for example, aerosol assisted deposition, direct liquid injection, hot-wall thermal deposition, cold wall deposition, microwave-plasma assisted deposition, plasma-enhanced deposition, etc.

FIG. 9 shows an exemplary hot-wall thermal chemical vapor deposition process 74. The hot-wall thermal chemical vapor deposition process 74 may supply carrier gas 76 to carry the source material 78 onto the substrate surface 44 of the insulator 22. In some embodiments, the insulator 22 may be a first of a plurality of insulators 22. The source material 78 may react with the substrate surface 44 and be deposited onto the substrate surface 44 creating the thin film 72. In some embodiments, the hot-wall thermal chemical vapor deposition process 74 may use one heater 80 or a plurality of heaters 80 to supply heat. The heat from the heater 80 may be used as a catalyst to initiate a chemical reaction between the source material 78 and the substrate surface 44. It may be desirable that the heater 80 does not heat the substrate past a threshold temperature. For example, the threshold temperature may be lower than the melting temperature of the filler material 52 of the brazing process 46 of FIG. 5. By operating below the threshold temperature the chemical vapor deposition process may be carried out after the joining process of the insulator 22 with the support 40.

Although the invention has been described with reference to the embodiments illustrated in the attached drawing figures, it is noted that equivalents may be employed and substitutions made herein without departing from the scope of the invention as recited in the claims.

Having thus described various embodiments of the invention, what is claimed as new and desired to be protected by Letters Patent includes the following:

1. A method for manufacturing an x-ray tube, said x-ray tube comprising a frame, an anode, a cathode, and at least one insulator surrounding the cathode, the method comprising the steps of:

securing the at least one insulator to at least one support by brazing using a filler material, then applying a layer of a conductive dissipative coating to a surface of the insulator using a vapor deposition process, wherein the vapor deposition process uses a temperature that is lower than the melting point temperature of the filler material, wherein the conductive dissipative coating is configured to reduce an electrical charge buildup on the at least one insulator.

2. The method of claim 1, wherein:

the at least one insulator is a plurality of insulators;

the at least one support is a plurality of supports;

each of the plurality of insulators are secured to a respective support; and the conductive dissipative coating is applied to each of the plurality of insulators simultaneously.

3. The method of claim 1, wherein the layer of the conductive dissipative coating is a first layer, the method further comprising the step of applying a second layer of conductive dissipative coating on top of the first layer using the vapor deposition process.

4. The method of claim 1, further comprising the step of removing the insulator from the x-ray tube for recycling or for use in a second x-ray tube.

5. The method of claim 1, wherein the vapor deposition process is a physical vapor deposition process.

6. The method of claim 1, wherein the vapor deposition process is a chemical vapor deposition process.

7. The method of claim 1, wherein the vapor deposition process is a sputtering process.

8. The method of claim 1, wherein the vapor deposition process is a cathodic arc deposition process.

9. The method of claim 1, wherein the vapor deposition process is a hot-wall thermal chemical vapor deposition process.

10. A system for reducing electrical charge buildup of an x-ray tube, the system comprising:

a frame;

an anode;

a cathode;

an insulator joining the cathode to the frame, the insulator comprising:

at least one surface having a conductive dissipative coating thereon, whereby said conductive dissipative coating is applied by a vapor deposition process, wherein the conductive dissipative coating is configured to reduce an electrical charge buildup on the insulator, wherein the insulator is joined to at least one support via a brazing process using a filler material before the conductive dissipative coating is applied, and wherein the vapor deposition process uses a temperature that is lower than the melting point temperature of the filler material.

11. The system of claim 10, wherein the at least one support joins the insulator to the frame.

12. The system of claim 11, wherein the at least one support comprises metal.

13. The system of claim 10, wherein the conductive dissipative coating comprises nitrides.

14. The system of claim 10, wherein the conductive dissipative coating comprises aluminum nitride, boron nitride, chromium nitride, silicon nitride, titanium nitride, or combinations thereof.

15. The system of claim 10, wherein the conductive dissipative coating comprises a plurality of layers.

16. The system of claim 15, wherein each layer comprises a different material.

17. The system of claim 10, wherein the insulator comprises ceramic or glass.

18. The system of claim 10, wherein the at least one surface is an outer surface of the insulator.

19. A method for manufacturing a plurality of insulators of a respective plurality of x-ray tubes, the method comprising the steps of:

securing the plurality of insulators to a respective plurality of supports by brazing using a filler material;

then applying a conductive dissipative coating to a surface of each of the plurality of insulators simultaneously using a vapor deposition process, wherein the vapor deposition process uses a temperature that is lower than the melting point temperature of the filler material, wherein the conductive dissipative coating is configured to reduce an electrical charge buildup of each of the insulators.

20. The method of claim 19, further comprising the step of:

applying a second conductive dissipative coating to the surface of each of the plurality of insulators simultaneously using the vapor deposition process.

* * * * *